US006988640B2

(12) United States Patent
Backe

(10) Patent No.: US 6,988,640 B2
(45) Date of Patent: Jan. 24, 2006

(54) DRIP PAN FOR A LIQUID CONTAINING DRUM

(76) Inventor: Michael Backe, 8480 Tallahassee Dr., NE., St. Petersburg, FL (US) 33702

( * ) Notice: Subject to any disclaimer, the term of this patent is extended or adjusted under 35 U.S.C. 154(b) by 169 days.

(21) Appl. No.: 10/639,995

(22) Filed: Aug. 13, 2003

(65) Prior Publication Data

US 2005/0035151 A1 Feb. 17, 2005

(51) Int. Cl.
*B67D 1/16* (2006.01)

(52) U.S. Cl. ..... 222/109; 222/383.1; 222/189.06; 222/189.09; 141/364; 141/331; 220/601

(58) Field of Classification Search ..... 222/108–109, 222/111, 385, 189.06, 189.09, 189.1, 321.9, 222/383.1; 220/661, 694, 571, 601, 745–746; 141/106, 331–334, 338–339, 343–346, 364
See application file for complete search history.

(56) References Cited

U.S. PATENT DOCUMENTS

| | | | | |
|---|---|---|---|---|
| 129,141 A | | 7/1872 | Kelly | |
| RE6,396 E | | 4/1875 | Gray | |
| 623,345 A | | 4/1899 | Wagandt | |
| 1,246,819 A | | 11/1917 | Lewis | |
| 1,517,805 A | * | 12/1924 | Spaeth | 222/109 |
| 4,796,677 A | * | 1/1989 | Nice | 141/88 |
| 5,120,454 A | | 6/1992 | Wieties | |
| 5,184,751 A | * | 2/1993 | Middleton | 220/694 |
| 5,275,313 A | | 1/1994 | Petrillo et al. | |
| 5,291,921 A | * | 3/1994 | Devine | 141/86 |
| 5,415,210 A | * | 5/1995 | Hannah | 141/333 |
| 5,647,415 A | * | 7/1997 | Onders et al. | 144/331 |
| 6,742,557 B1 | * | 6/2004 | Backe | 141/364 |

* cited by examiner

*Primary Examiner*—Frederick Nicolas
(74) *Attorney, Agent, or Firm*—Larson & Larson, PA; Herbert W. Larson

(57) ABSTRACT

An annular pan for mounting over a drum lid containing a liquid, the drum top having a hole for a pump conduit and an air hole. The annular pan has multiple parallel elongated walls increasing in height from the pump conduit to a portion of the pan containing a drain hole axially aligned with the drum lid air hole. The drain hole contains a filter for preventing particles from entering the drum. A raised edge of the pan above a top surface of the pan has an indentation for receipt of the pump conduit.

19 Claims, 13 Drawing Sheets

DRIP PAN FOR A LIQUID CONTAINING DRUM

BACKGROUND OF THE INVENTION

This invention relates to a pan for collecting liquids spilled while pumping such liquid from a drum. More specifically, it refers to a pan cover for a top of a liquid containing drum, the cover having channels for directing spilled liquid to a filter in a drain leading back to the drum.

U.S. Pat. Nos. 6,396; 129,141 and 623,345 describe liquid drums with a pump mounted at a top of the drum to pump liquid from the drum. Conduits in the drum lid return spilled liquids back inside the drum. Various other funnels and drip plates are known for placement over a drum to catch leaks and drips. These prior art lids, funnels and drip plates do not have easily installed filters to trap debris from falling into the drum. A pan cover for a fifty-five gallon standard liquid drum that has an efficient drain channel with an easily inserted filter at a drain hole aligned with an air hole in the drum is needed.

SUMMARY OF THE INVENTION

The present invention provides a drip pan for a fifty-five gallon standard liquid containing drum, the drum having a first hole in a top surface for passage of a pump conduit and a second hole constituting an air hole. The drip pan has an annular shape to cover the top of the drum. A multiplicity of parallel walls increasing in height from the pump conduit to a drain hole, channels dripping liquid downwardly to the drain hole. The drain hole is axially aligned with the air hole on the drum. The drain hole has a threaded annular side wall which is engaged by complimentary external threads on a hollow stem of a plug for the drain hole. A top portion of the plug above the hollow stem constitutes a filter for preventing large solids from entering the drum. A fine filter is located in the hollow stem of the plug. By easily inserting and turning the plug, the drip pan is ready for receipt of any liquid dripping from the spout at the end of the pump conduit.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION

Figure 1:
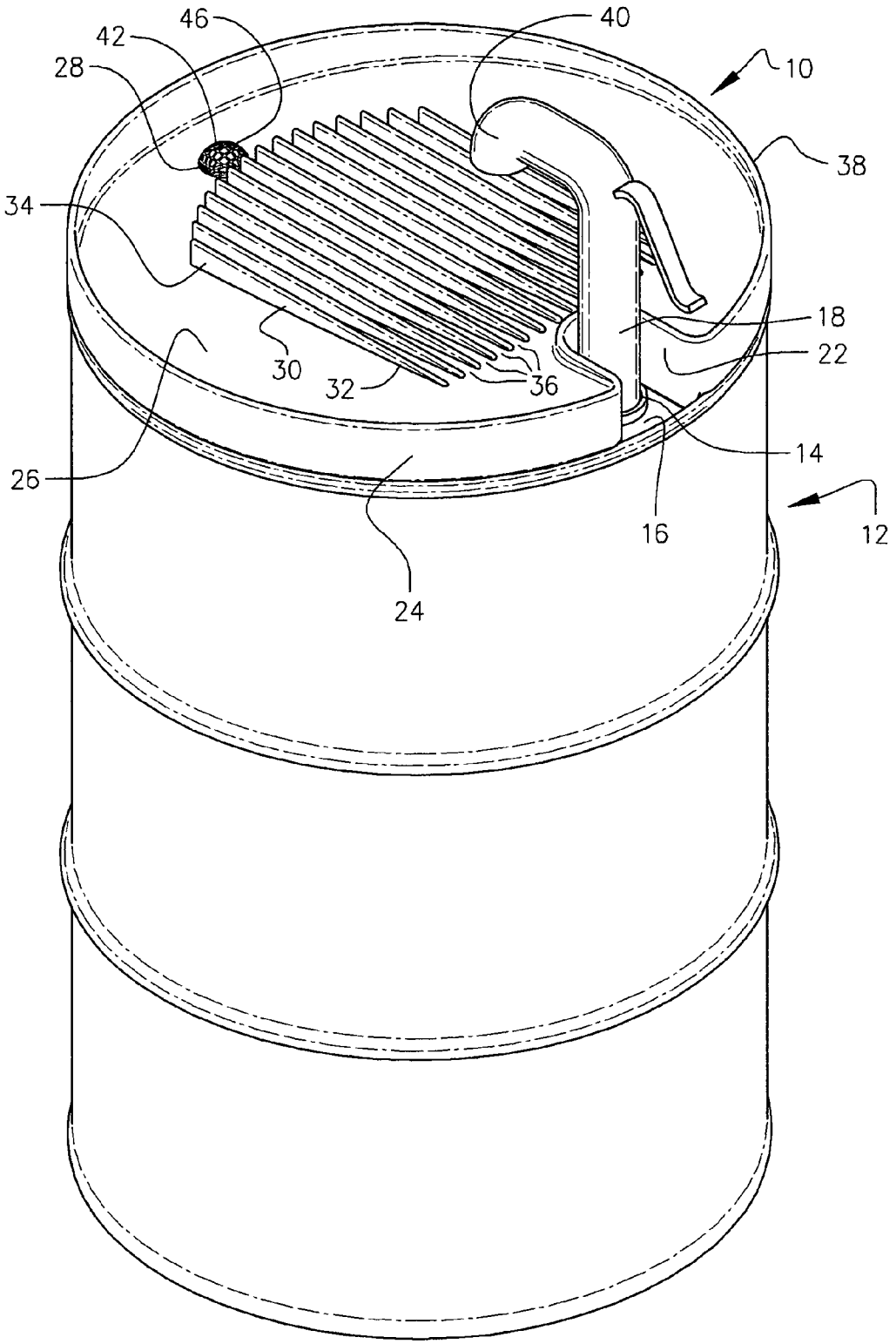
FIG. 1 is a perspective view of a fifty-five gallon drum with an installed pump in its lid, the lid covered by the drain pan of this invention.

Throughout the following detailed description, the same reference numerals refer to the same elements in all figures.

Figure 2:
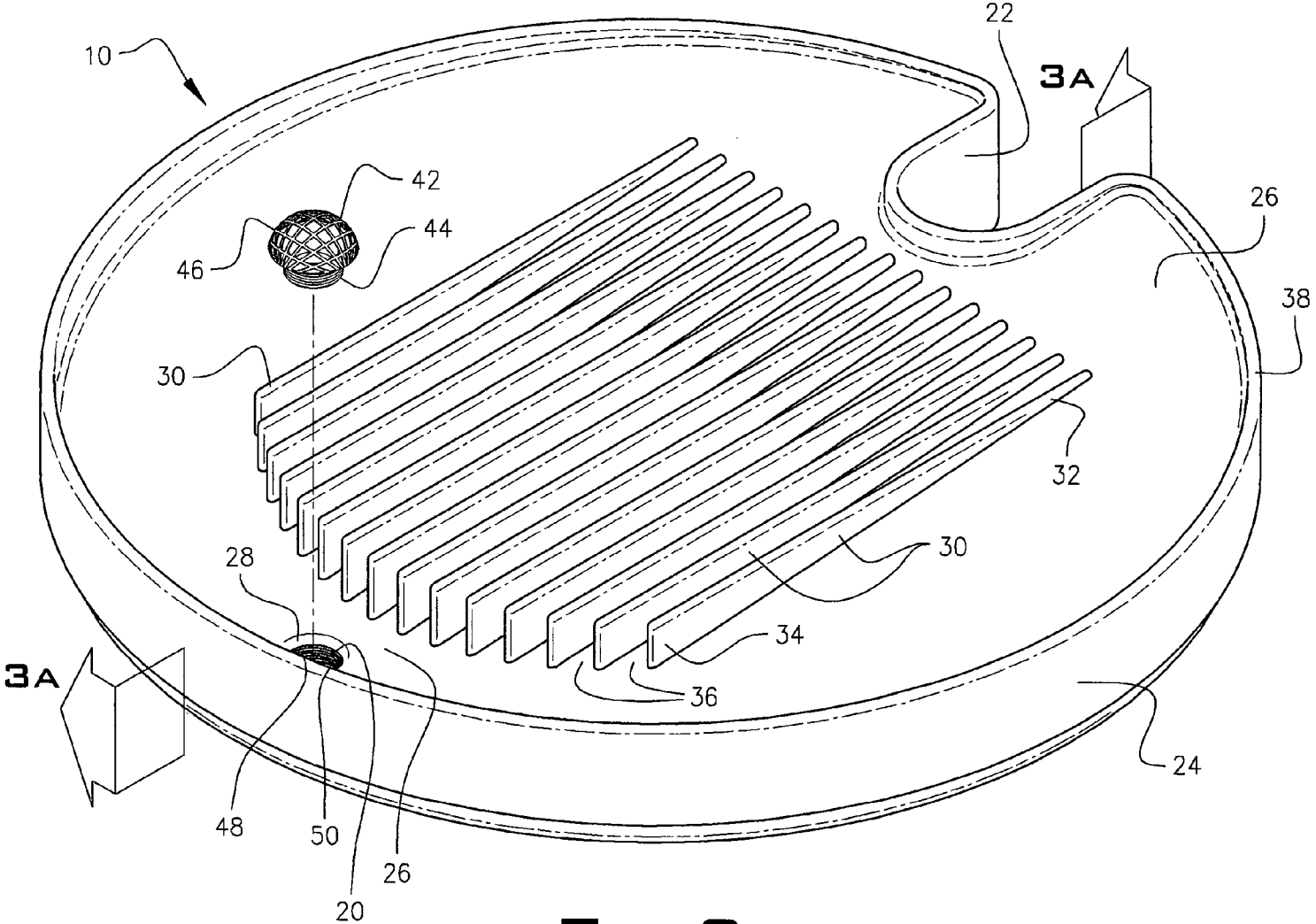
FIG. 2 is a perspective view of the drain pan of this invention with its filter plug ready for insertion in a drain hole.

Referring to FIGS. 1 and 2, the drip pan 10 of this invention has an annular external shape complimentary to the shape of a top surface 16 of a drum 12, preferably a standard fifty-five gallon drum 12 containing a liquid. The drum 12 has a first hole 14 in top surface 16 through which a pump conduit 18 projects upwardly. A second hole 20 is an air hole through top surface 16.

Figure 3A:
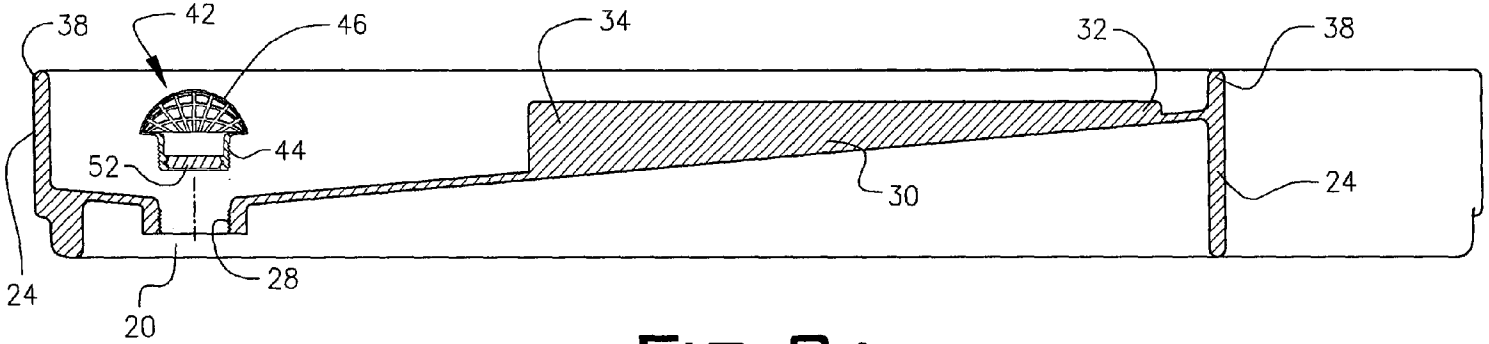
FIG. 3A is a cross-sectional view along line 3A—3A in FIG. 2.

The drip pan 10 is positioned over top surface 16 so that an indentation 22 in a side wall 24 accommodates the pump conduit 18. A top surface 26 of the drip pan 10 slants downwardly from a portion around indentation 22 to a drain hole 28 that is axially aligned to air hole 20 in drum 12. Multiple parallel walls 30 increase in height from a portion 32 to a portion 34 as seen in FIG. 3A. The parallel walls 30 form channels 36 which direct liquid, dripping from spout 40 at an end of pump conduit 18, to the drain hole 28. A rim 38 raises above top surface 26 to form the top edge of side wall 24.

Figure 3B:
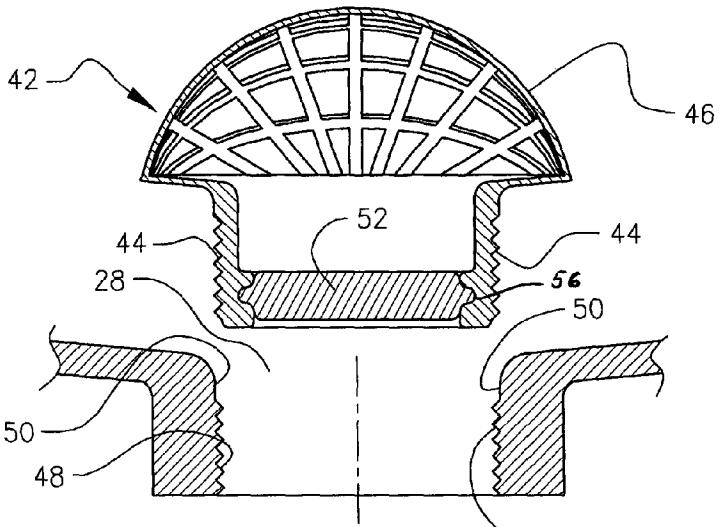
FIG. 3B is a cross-sectional exploded view of the drain hole of FIG. 2 and the filter plug.
Figure 4:
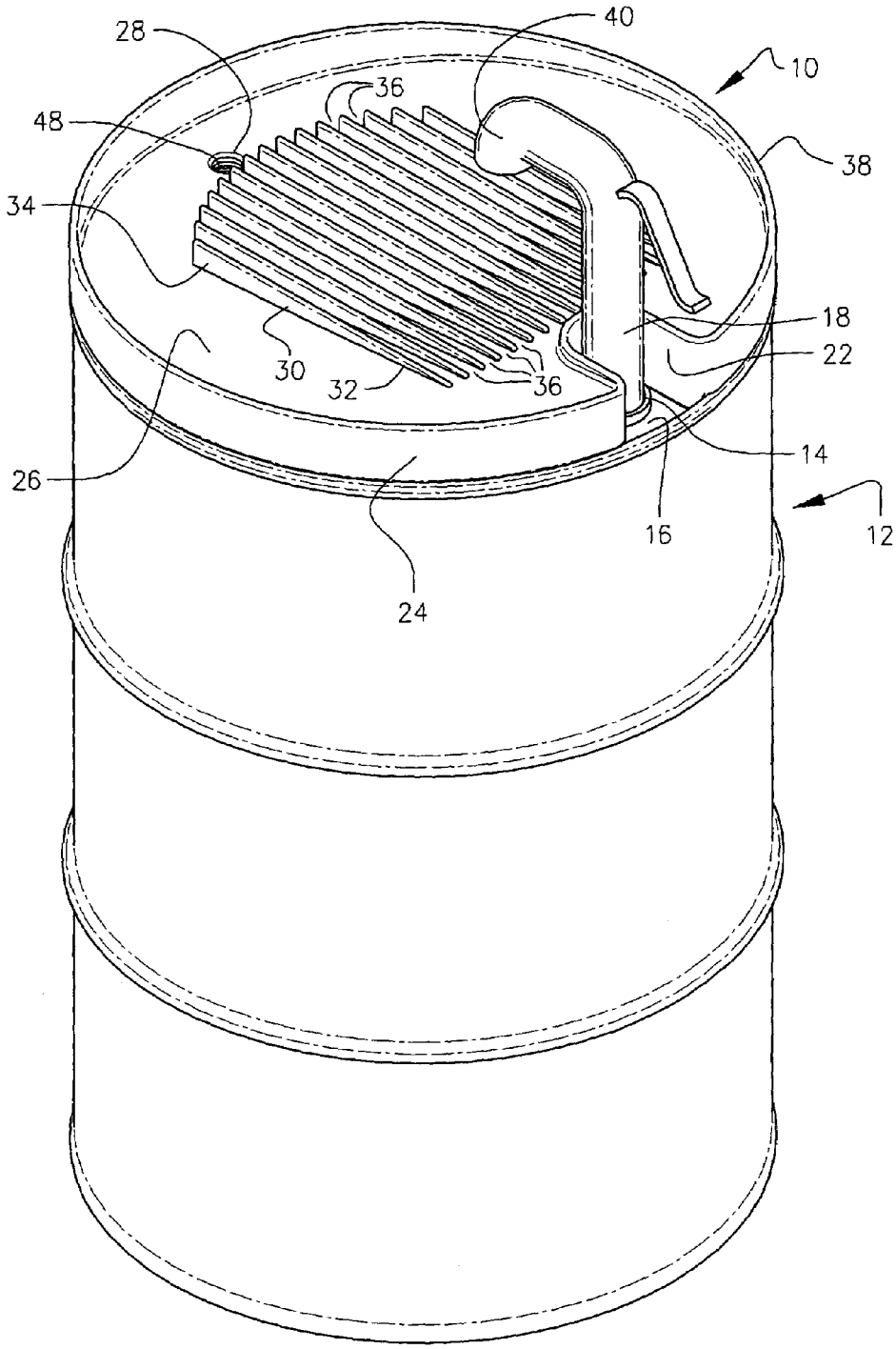
FIG. 4 is a perspective view of a fifty-five gallon drum with an alternate filter in the drain hole of a drain pan covering the drum lid.

An easily inserted drain hole plug 42 is threadable engaged to drain hole 28. Plug 42 has a downwardly depending threaded hollow stem 44 and an integral domed large particle filter 46 above the stem. The threaded stem 44 engages complimentary threads 48 in side wall 50 of drain hole 28. As seen in FIGS. 3A and 3B, a fine filter 52 is snapped into groove 56 in side wall 50 of plug 42. A clockwise turning seats the plug 42 in drain hole 28. If the filters 46 or 52, become clogged with debris, the plug 42 can be unscrewed by turning in a counterclockwise direction, the filters cleared and the plug quickly replaced.

Figure 5:
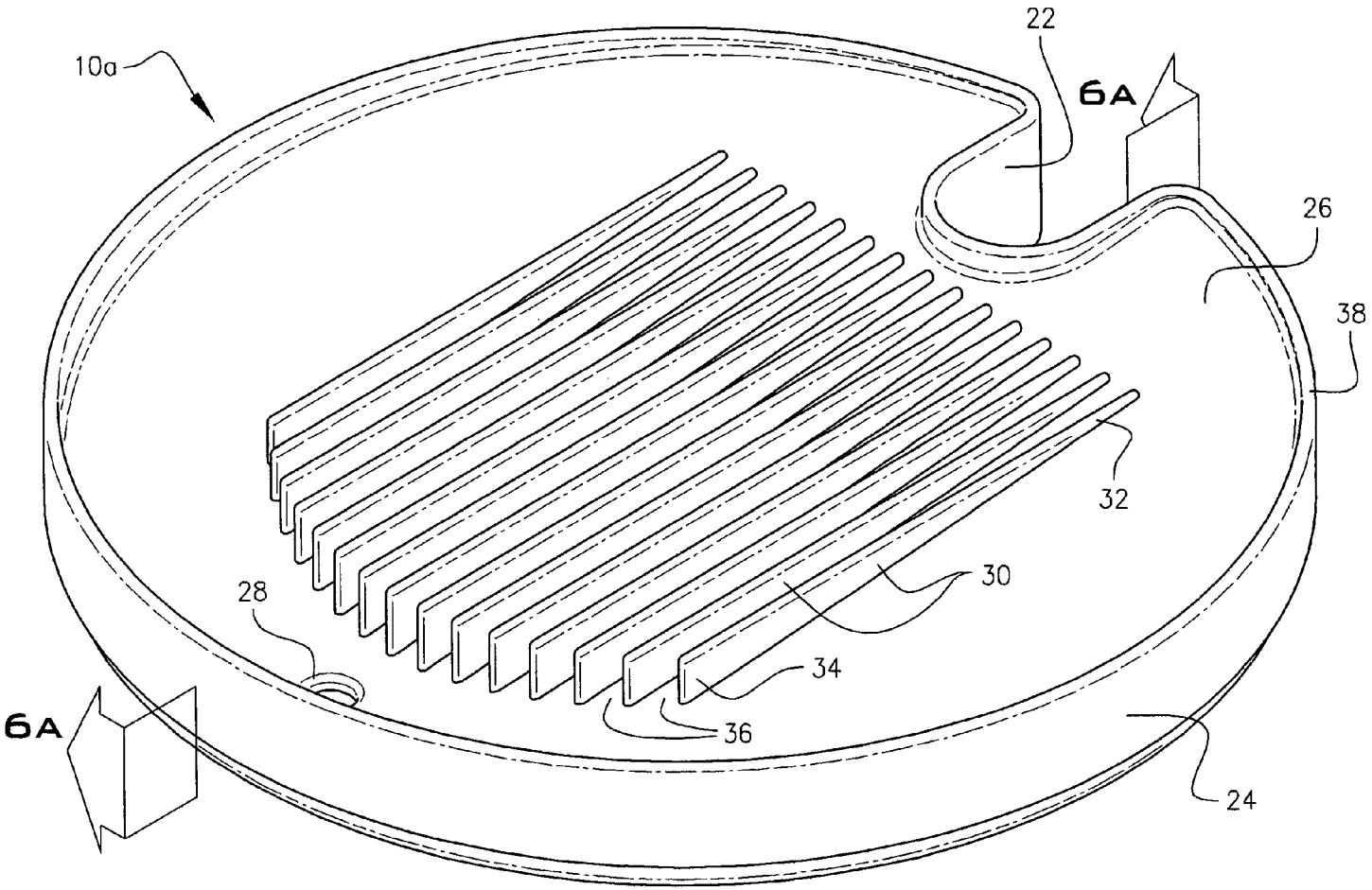
FIG. 5 is a perspective view of the drain pan of FIG. 4.
Figure 6A:
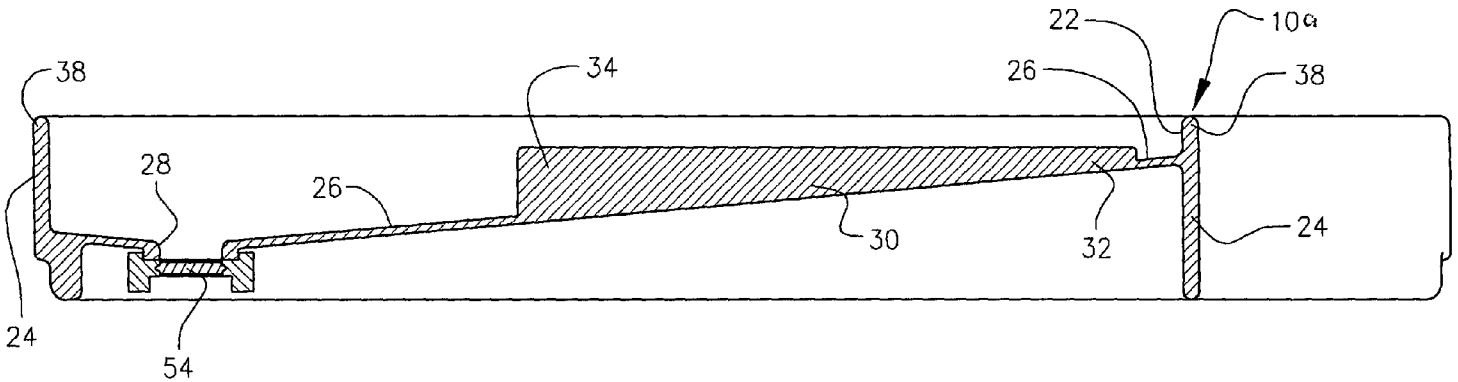
FIG. 6A is a cross-sectional view along line 6A—6A of FIG. 5.
Figure 6B:
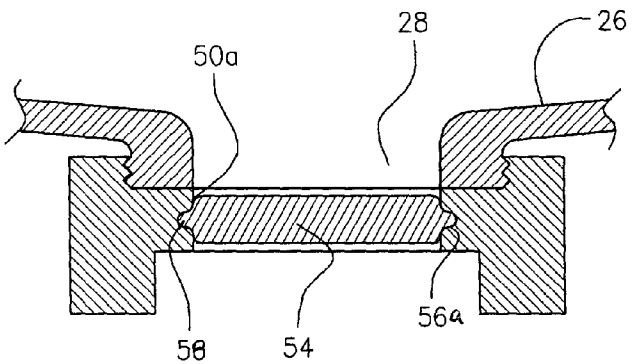
FIG. 6B is a cross-sectional view of the drain hole in FIG. 5 with a filter in the drain hole.

Alternatively, as seen in FIGS. 5, 6A AND 6B, a drip pan 10*a* can substitute a fine particle filter 54*a* snapped into side groove 56*a* in drain hole 28. The wall 50*a* of drain 28 contains the groove 56*a* to accommodate ring projection 58 around filter 54*a*.

Figure 7:
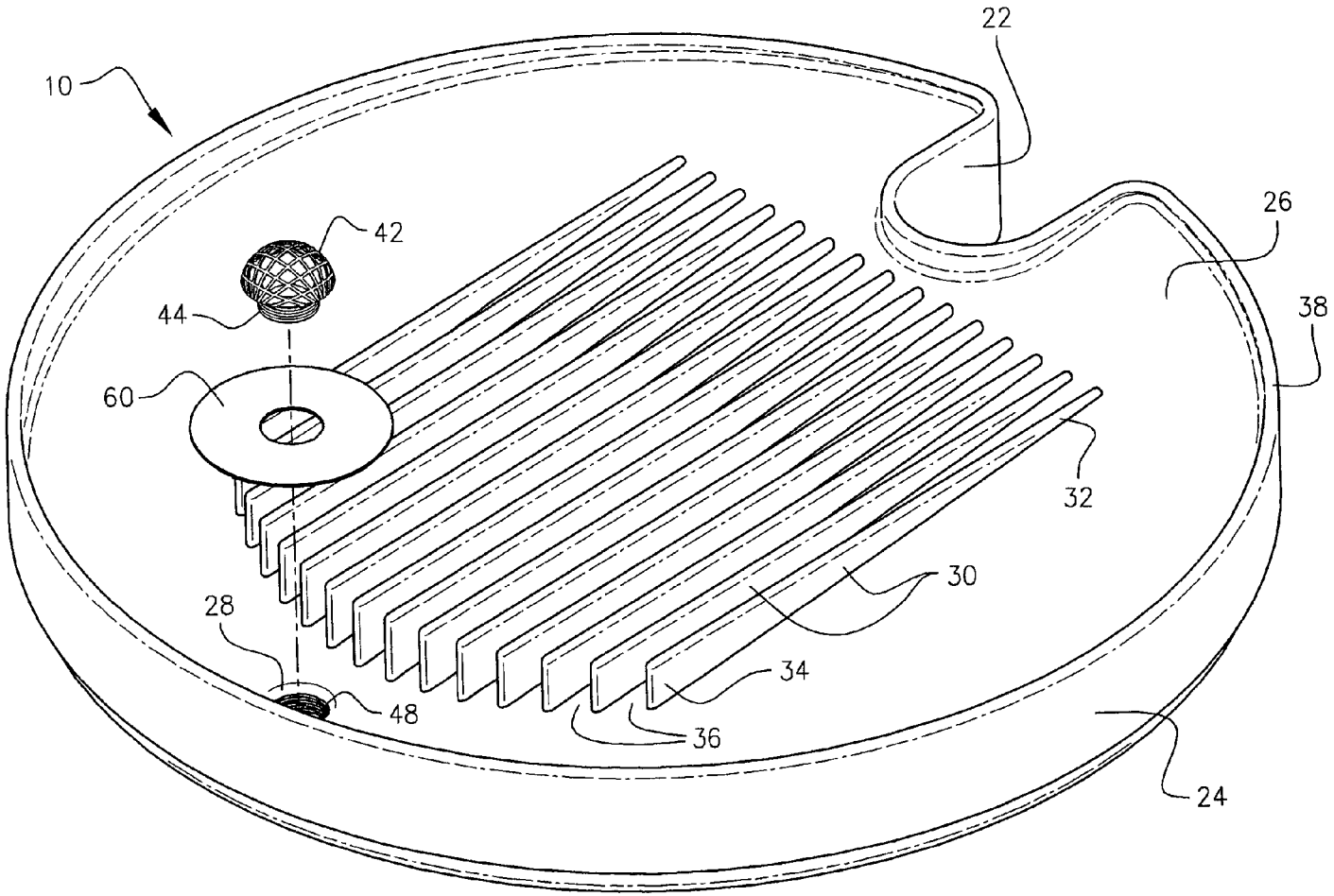
FIG. 7 is an exploded perspective view of the drain pan of FIG. 2 with the addition of a magnetic ring around the drain hole.

As seen in FIG. 7, a magnetized annular ring 60 surrounds stem 44 of plug 42 and is juxtaposed over the drip pan top surface 26. Any iron metal particles passing through channels 36 towards the drain hole 28 will be captured on ring 60.

Figure 8:
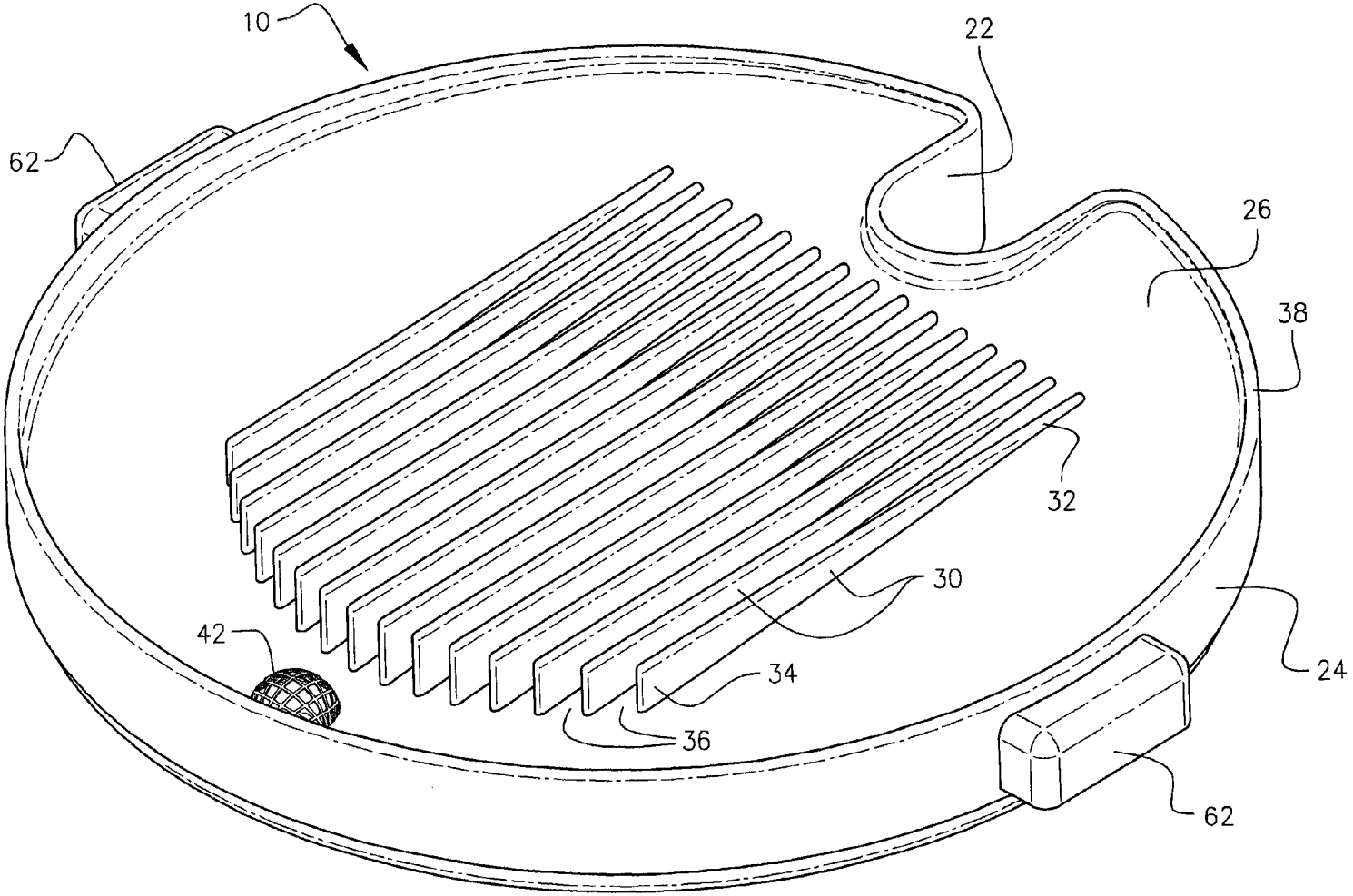
FIG. 8 is a perspective view of the drain pan of FIG. 2 with oppositely opposed side edge handles.

Optimally, as seen in FIG. 8 handles 62 can be fastened by glue, spot welding or by screws to sidewall 24.

Figure 9:
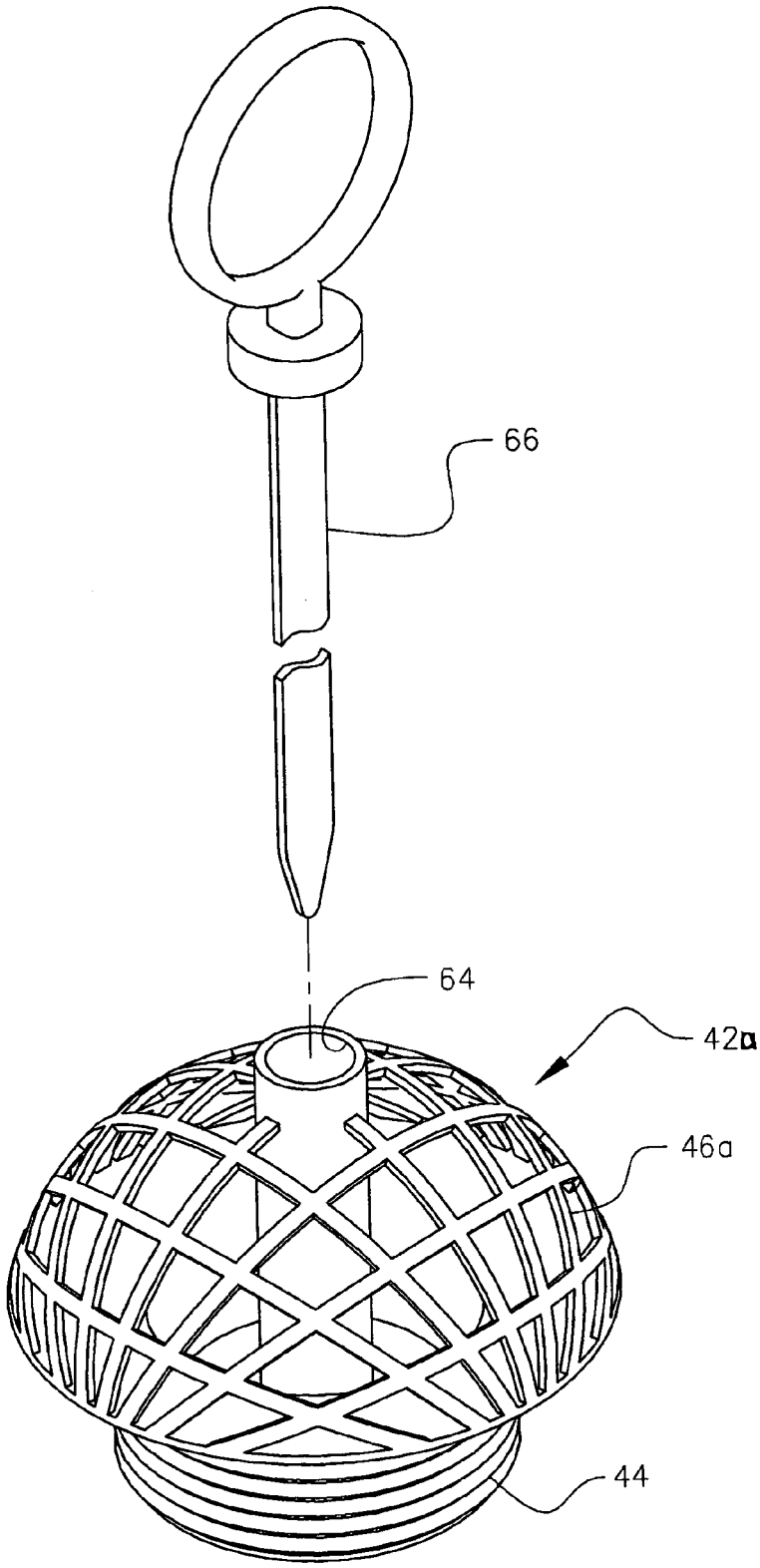
FIG. 9 is an exploded view of a drain plug having a central hollow column for receiving a dip stick.

As seen in FIG. 9, plug 42*a* can have a hollow cylindrical channel 64 vertically centered in the domed large particle filter 46*a* so that a dip stick 66 can determine the amount of liquid remaining in drum 12.

Figure 10:
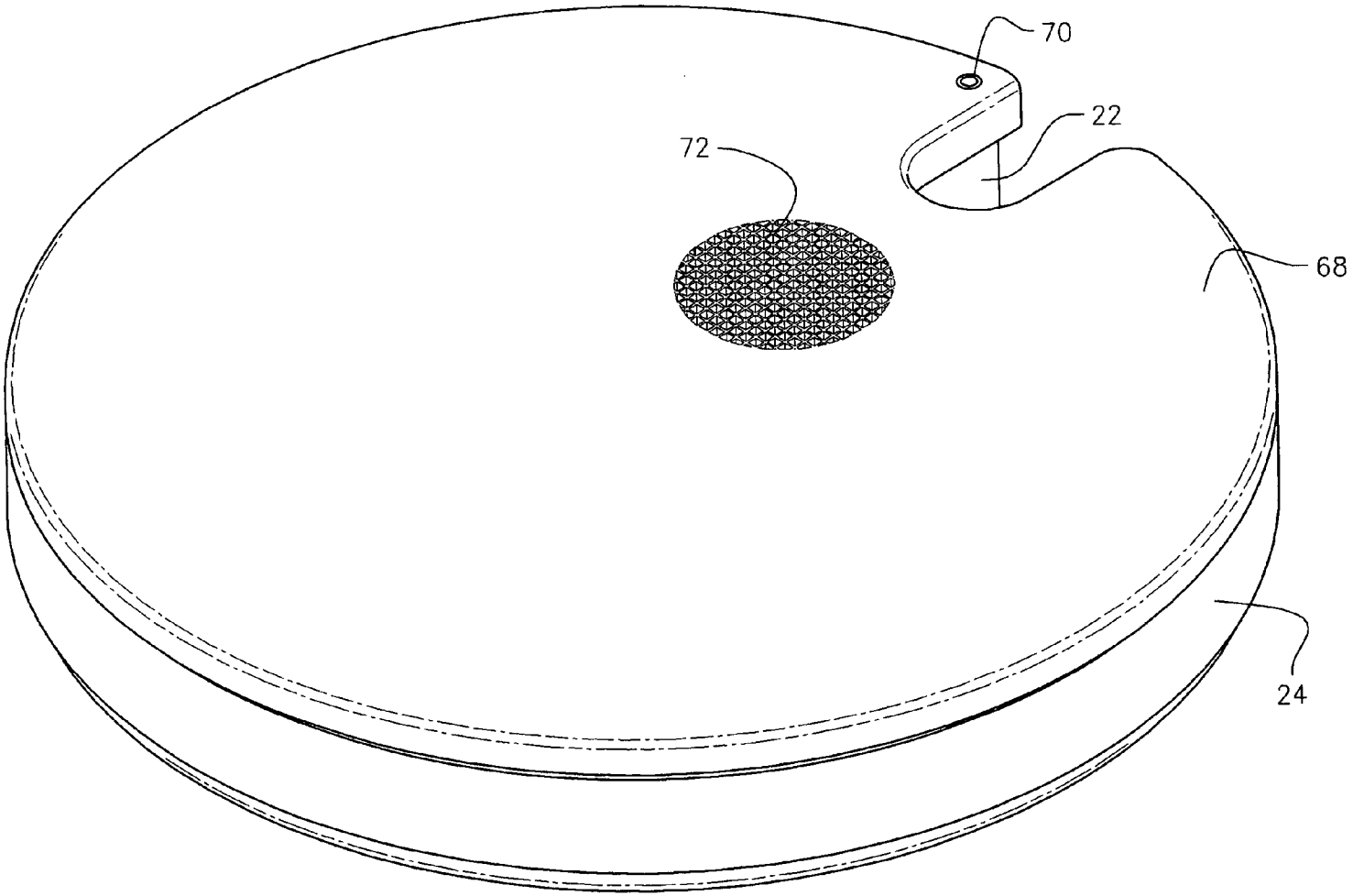
FIG. 10 is a perspective view of a cover over a drip pan of this invention.
Figure 11:
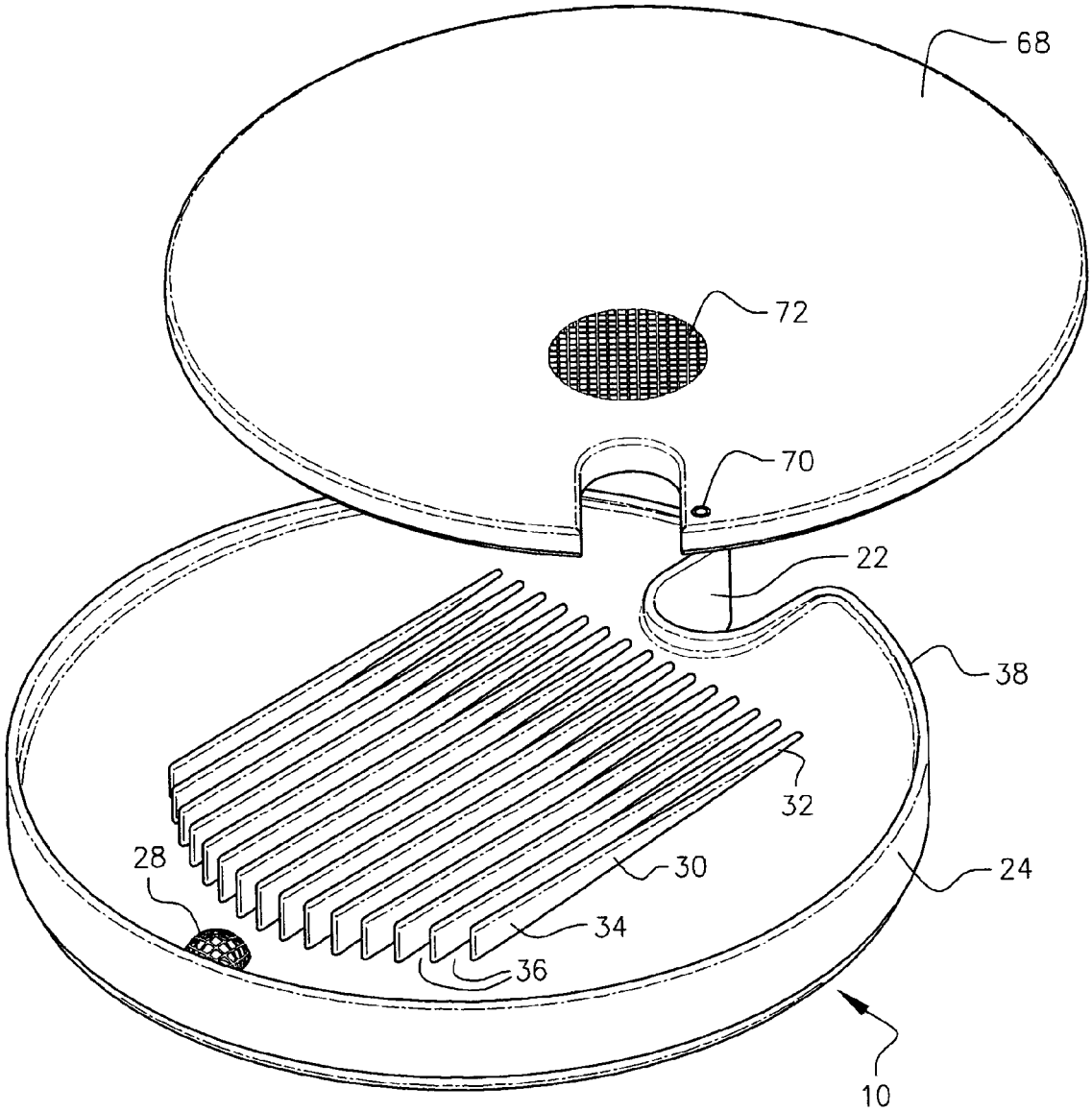
FIG. 11 is a perspective view of the cover shown in FIG. 10 hinged away from the drip pan.

As seen in FIGS. 10 and 11, the drip pan 10 can optionally have an annular cover plate 68 hinged 70 on the rim 38 of side wall 24. The cover plate 68 has a filter 72 to prevent entry of large debris onto drip pan 10.

Figure 12:
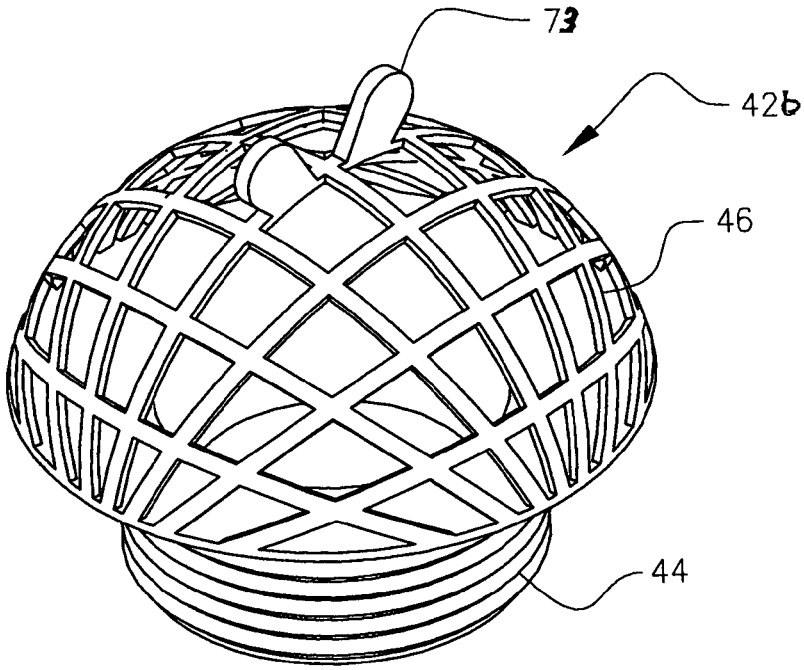
FIG. 12 is a perspective view of a drip pan plug with a wing nut molded to its top.

Referring to FIG. 12, the plug 42*b* can have a wing nut 73 centered over the domed filter 46 to increase the ease of turning plug 42*b* in drain hole 28.

Figure 13:
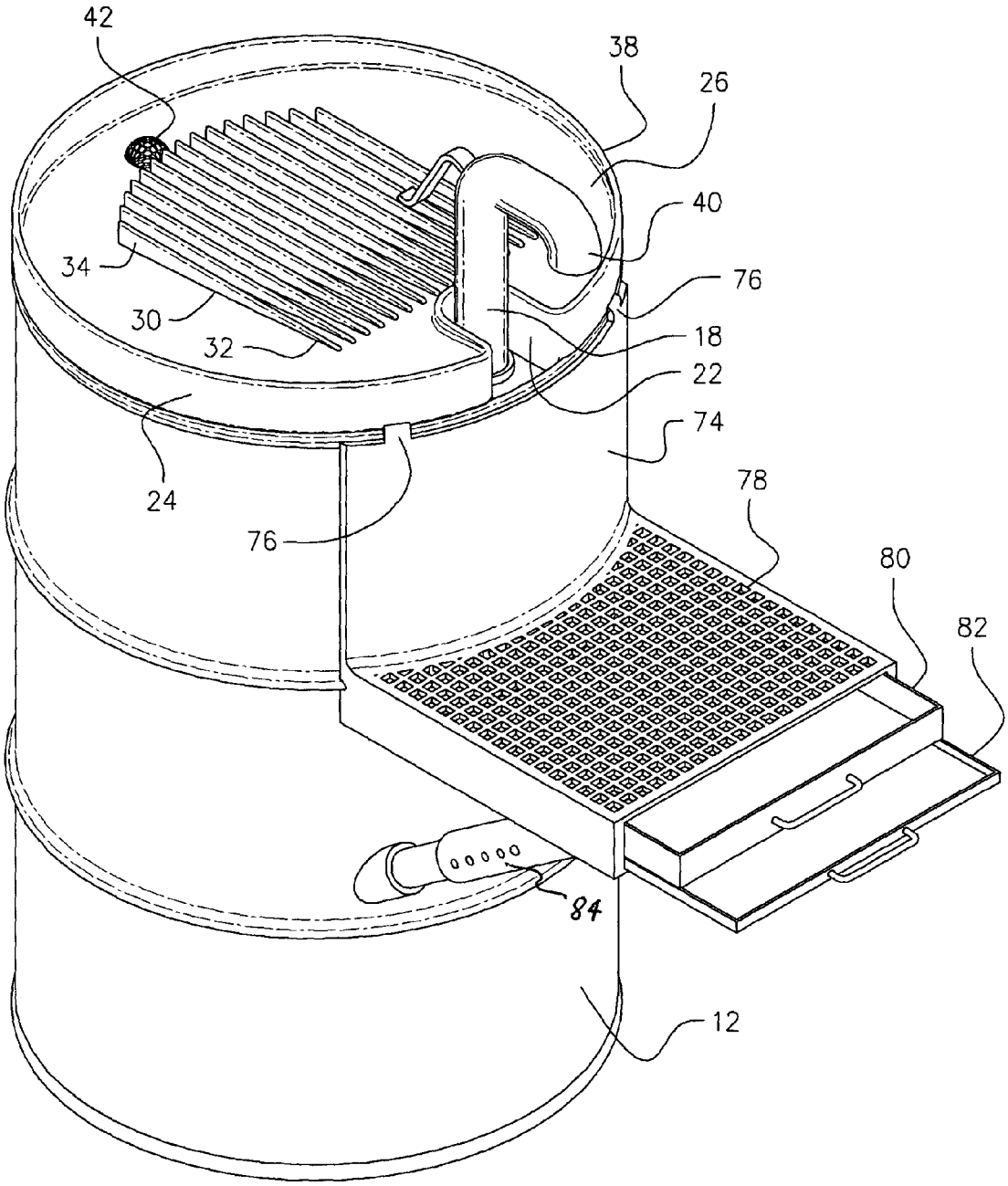
FIG. 13 is a perspective view of a fifty-five gallon drum with a drip pan on its top and a hanging small bucket filling bracket.

Referring to FIG. 13, in order to accommodate small buckets or cans, a skirt 74 can be hung by U-tabs 76 on drum 12. Integral with the skirt 74 is a filter grate 78 which allows dripped liquid to flow into drawer 80. A support drawer 82 is substantially at a level parallel to the ground on which the drum 12 is placed. The skirt and grate 78 are supported in the parallel position to the ground by support arm 84.

The drip pan 10 and its parts can be made from steel or aluminum or from a high strength polymer such as polycarbonate or polypropylene.

Other equivalent elements can be substituted for the elements of the inventive drip pan 10 to accomplish the same results in the same way.

Having disclosed the invention, what is claimed for Letters Patent follows:

1. An annular drip pan mountable over a drum lid, the drum lid being a top element of a drum containing a liquid, a pump mounted through a first opening in the drum lid and a second opening as an air hole in the drum lid, the annular drip pan comprising, multiple parallel channels on a top surface for conducting liquids in the drip pan downwardly from the pump to a drain hole, each multiple parallel channel formed between a pair of longitudinally extending walls having a height increasing from the pump conduit to a portion of the drip pan adjacent the drain hole, the drain hole vertically aligned with the second opening in the drum lid;

a filter mounted in the drain hole to prevent solid particles from falling into the drum; and the annular drip pan having a raised annular rim over the top surface and a side edge having a U-shaped indentation to accommodate an upwardly directed pump conduit.

2. The annular drip pan according to claim 1 wherein the drain hole has internal threads for threadably engaging complimentary external threads on a downwardly directed hollow stem of a plug having an integral first filter over the stem and a second filter transverse to an inner wall of the stem.

3. The annular drip pan according to claim 1 wherein the filter is mounted to an internal side surface in the drain hole.

4. The annular drip pan according to claim 2 wherein a magnetic annular ring surrounds a top portion of the stem and is substantially flush with the top surface of the drip pan so that it attracts metal elements in the liquid.

5. The annular drip pan according to claim 1 wherein the side edge has a pair of oppositely mounted handles for moving the annular drip pan.

6. The annular drip pan according to claim 2 wherein the stem has a cylindrical member mounted within the hollow portion for receipt of a dip stick.

7. The annular drip pan according to claim 1 wherein a hinged annular cover encloses the drip pan, the cover having a filter for passage of liquids.

8. The annular drip pan according to claim 2 wherein a wing nut is mounted over the domed filter to assist in turning the plug.

9. The annular drip pan according to claim 1 wherein a secondary filter is attached to a side of the drum for filtering a spilled liquid when the pump conduit is turned for filling a small bucket.

10. The annular drip pan according to claim 1 wherein the drum lid covers a fifty-five gallon drum.

11. In a liquid containing cylindrical drum closed at a first end with a base member and at a second end with a lid, the lid having a vertical conduit for a pump passing through a first opening and a second opening as an air hole, the lid covered with an annular drip pan, the improvement wherein the annular drip pan comprises, multiple parallel channels on a top surface for conducting the liquid dripping from the pump downwardly to a portion of the drip pan containing a drain hole, the drain hole vertically aligned with the second opening in the drum lid;

a filter mounted in the drain hole to prevent solid particles from falling into the drum;

the annular drip pan having a raised annular rim over the top surface and a side edge having a U-shaped indentation to accommodate the vertical conduit for directing the pump; and one of each multiple parallel channel formed between a pair of longitudinally extending walls having a height increasing from the pump conduit to the portion of the drip pan containing the drain hole.

12. The annular drip pan improvement according to claim 11 wherein the drain hole has internal threads for threadably engaging complimentary external threads on a downwardly directed hollow stem of a plug having an integral domed filter over the stem.

13. The annular drip pan improvement according to claim 11 wherein the filter is mounted to an internal side surface of the drain hole.

14. The annular drip pan improvement according to claim 12 wherein a magnetic annular ring surrounds a top portion of the stem and is substantially flush with the top surface of the drip pan so that it attracts metal elements in the liquid.

15. The annular drip pan improvement according to claim 11 wherein the drip pan is mounted over the lid of a fifty-five gallon drum.

16. An annular drip pan mounted over a drum lid of a fifty-five gallon drum containing a liquid, the annular drip pan comprising, multiple parallel channels on a top inclined surface, the channels each formed between a pair of longitudinally extending walls having a height increasing from a pump conduit mounted through the drum lid to a portion of the drip pan adjacent a drain hole, the drain hole axially aligned with an air hole in the drum lid;

a filter mounted in the drain hole to prevent solid particles from falling into the drum; and a raised annular rim over the top surface and a side edge having an indentation to accommodate the pump conduit.

17. The annular drip pan according to claim 16 wherein the filter is mounted in a groove in an internal annular wall in the drain hole.

18. The annular drip pan according to claim 16 wherein the filter is positioned as a cap on a hollow cylindrical plug for the drain hole, the plug having a downwardly directed hollow stem with external threads threadably engaged to threads on an annular wall in the drain hole.

19. The annular drip pan according to claim 18 wherein a magnetic annular ring surrounds the stem juxtaposed to the top surface for attracting metal particles in liquid flowing towards the drain hole.

* * * * *